US007896034B2

(12) United States Patent
Harwood et al.

(10) Patent No.: US 7,896,034 B2
(45) Date of Patent: Mar. 1, 2011

(54) HEAT- AND CORROSION-RESISTANT FABRIC

(75) Inventors: William Harwood, Waycross, GA (US); Gilbert Ross, Waycross, GA (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/406,604

(22) Filed: Mar. 18, 2009

(65) Prior Publication Data

US 2010/0236656 A1 Sep. 23, 2010

(51) Int. Cl.
*D03D 3/04* (2006.01)
*D03D 15/00* (2006.01)
*D03D 25/00* (2006.01)

(52) U.S. Cl. ..... 139/383 A; 139/420 R; 139/426 R; 139/420 A

(58) Field of Classification Search ..... 139/383 R, 139/387 R, 390, 388, 416, 420 R, 426 R, 139/420 A, 383 A, 383 AA
See application file for complete search history.

(56) References Cited

U.S. PATENT DOCUMENTS

| | | | | |
|---|---|---|---|---|
| 7,094,467 | B2 | 8/2006 | Zhang et al. | |
| 7,425,364 | B2 | 9/2008 | Harwood et al. | |
| 2007/0111625 | A1 * | 5/2007 | Morton | 442/270 |
| 2007/0215304 | A1 * | 9/2007 | Lippi Alves Fernandes et al. | 162/358.4 |
| 2007/0251659 | A1 * | 11/2007 | Fernandes et al. | 162/205 |
| 2007/0251660 | A1 * | 11/2007 | Walkenhaus et al. | 162/205 |
| 2008/0230199 | A1 * | 9/2008 | Harwood | 162/358.2 |

* cited by examiner

*Primary Examiner*—Bobby H Muromoto, Jr.
(74) *Attorney, Agent, or Firm*—Quarles & Brady LLP

(57) ABSTRACT

A fabric for supporting a fibrous web is disclosed. The fabric has a layer that includes a plurality of weft yarns and a plurality of warp yarns interwoven with the plurality of weft yarns. The warp and weft yarns define a web-facing side and an opposite machine-facing side. The warp yarns include at least one of polyphenylene sulfide (PPS) and polyetheretherketone (PEEK). In addition, a yarn count, weave pattern, and yarn shape of the fabric are configured such that molten polymer drops are scrapable from the web-facing side leaving an upper support surface that does not blemish a fibrous web supported by the fabric.

10 Claims, 4 Drawing Sheets

| | | | | |
|---|---|---|---|---|
| | X | X | X | 8 |
| | X | | X | 7 |
| X | X | | X | 6 |
| X | | | X | 5 |
| X | | X | X | 4 |
| X | | X | | 3 |
| X | X | X | | 2 |
| | X | X | | 1 |
| 1 | 2 | 3 | 4 | |

WEFT YARNS

WARP YARNS

HEAT- AND CORROSION-RESISTANT FABRIC

CROSS-REFERENCE TO RELATED APPLICATIONS

Not applicable.

STATEMENT CONCERNING FEDERALLY SPONSORED RESEARCH OR DEVELOPMENT

Not applicable.

FIELD OF THE INVENTION

The invention relates to fabrics for manufacturing non-woven textiles and paper products.

BACKGROUND OF THE INVENTION

Non-woven textiles, or simply "non-wovens", are well-known products formed from webs of randomly arranged and entangled fibers. In most cases, the fibers of non-wovens are bonded to each other, for example, adhesively, mechanically, thermally, or chemically. Non-wovens may be single use products with relatively low strength, such as hygienic wipes and the like. Non-wovens may also be stronger and more durable products, such as medical gowns and geotextiles.

Processes for forming non-wovens typically involve forming the fiber web on a structure of interwoven yarns, typically referred to as a forming fabric. These processes include, for example, wet forming, carding, spunbonding, and meltblowing. In both spunbonding and meltblowing processes, the fibers are formed of a molten polymer that is extruded through a die and eventually collects on the forming fabric. The molten polymer may be, for example, polyethylene terephthalate (PET), polyethylene (PE), polypropylene (PP), or copolymers of PET and PE, and the forming fabric is typically formed of PET yarns.

Both spunbonding and meltblown processes can occasionally produce drops of the molten polymer that adhere to the forming fabric. In some cases, adherence and accumulation of the molten drops can cause blemishes, burn holes, or other surface defects on the forming fabric. These defects can reduce the quality of non-wovens formed on the forming fabric; for example, a damaged forming fabric can create products with relatively rough surfaces or other undesirable characteristics. In most cases, it is easiest to replace a defective forming fabric with a new forming fabric.

Further still, in some cases the molten polymer drops can penetrate the web-facing side and accumulate within the fabric, thereby reducing the permeability and the usefulness of the fabric. Certain well-known chemicals, such as sulfuric acid ($H_2SO_4$) for PET and toluene or methyl ethyl ketone (MEK) for PE, could be used to dissolve the polymer drops; unfortunately, such chemicals would also damage the PET yarns of the forming fabric. As a result and as described above, it is easiest to replace a defective forming fabric with a new forming fabric.

Considering the limitations of previous fabrics, it would be desirable to have a fabric with heat resistance to resist damage from molten polymer drops produced in some non-woven forming processes. It would also be desirable for such a fabric to resist corrosion from common chemicals, such as chemicals that dissolve the polymer residues but do not harm the base fabric. Further still, it would also be desirable for such a fabric to dissipate static electricity in some cases; that is, it would be desirable for such a fabric to act as an antistatic fabric. Further still, it would be desirable for such a fabric to have a smooth upper surface, including in some cases, the seam between ends or different sections of the fabric.

SUMMARY OF THE INVENTION

In one non-limiting aspect, the present invention provides a fabric for supporting a fibrous web. The fabric comprises a layer that includes a plurality of weft yarns and a plurality of warp yarns interwoven with the plurality of weft yarns. The warp and weft yarns define a web-facing side and an opposite machine-facing side. The warp yarns comprise at least one of polyphenylene sulfide (PPS) and polyetheretherketone (PEEK). In addition, a yarn count, weave pattern, and yarn shape of the fabric are configured such that molten polymer drops are scrapable from the web-facing side leaving a support surface that does not blemish a fibrous web supported by the fabric.

In another non-limiting aspect of the invention, the fabric comprises a layer that has a web-facing side and a machine-facing side. The layer includes a plurality of weft yarns that comprise at least one of polyphenylene sulfide (PPS) and polyetheretherketone (PEEK). The layer further includes a plurality of warp yarns interwoven with the plurality of weft yarns. The warp yarns comprise at least one of PPS and PEEK. At least some of the warp yarns define floats over at least five consecutive weft yarns and have flat upper surfaces such that molten polymer drops do not penetrate an upper plane of the web-facing side.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

The invention will hereafter be described with reference to the accompanying drawings, wherein like reference numerals denote like elements, and.

DETAILED DESCRIPTION OF THE INVENTION

Figures 1, 2:
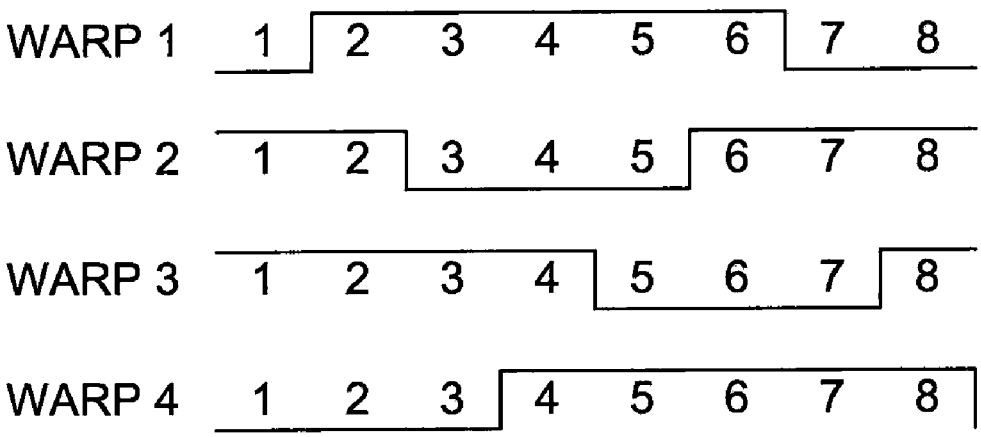
FIG. 1 shows an exemplary weave repeat of a fabric according to the invention.
FIG. 2 is a schematic representation of the weave pattern of individual warp yarns with weft yarns of the fabric of the invention.

The particulars shown herein are by way of example and only for purposes of illustrative discussion of the embodiments of the invention. The particulars shown herein are presented to provide what is believed to be the most useful and readily understood description of the principles and conceptual aspects of the invention. In this regard, no attempt is made to show structural details of the invention in more detail than is necessary for the fundamental understanding of the invention. The description taken with the drawings and photographs should make apparent to those skilled in the art how the several forms of the present invention may be embodied in practice.

It is noted that while the discussion of the invention that follows may refer specifically to forming fabrics in the non-wovens industry, the invention is applicable to other fabrics in the papermaking industry and other industrial applications. For example, the fabric of the invention may be used as an oven fabric or a dryer fabric on a papermaking machine.

Further, when an amount, concentration, or other value is given as a range of preferable upper values and preferable lower values, this should be understood as specifically disclosing all ranges formed from any combination of a preferable upper value and a preferable lower value, regardless of whether ranges are separately disclosed.

Referring to FIGS. 1-7, the fabric of the invention includes a layer 10, such as the base layer of the fabric, that has a web-facing side 12 and a machine-facing side 14. The layer 10 comprises interwoven warp (machine direction) yarns and weft (cross-machine direction) yarns. By way of non-limiting example, FIGS. 1-7 show a fabric having one layer of weft yarns. However, it is contemplated that the fabric may include any number of layers of weft yarns. Those skilled in the art would modify the number of layers based on any number of parameters, such as fabric length, weight and strength requirements, desired permeability, the type of product being produced, and the like. By way of non-limiting example, the fabric preferably has from one to three layers of weft yarns, and most preferably one or two layers of weft yarns.

Each warp yarn is made of a high temperature thermoset polymer; preferably polyphenylene sulfide (PPS), although polyetheretherketone (PEEK) may be used in some embodiments. In some embodiments, each warp yarn is a monofilament yarn made of extruded PPS or PEEK polymeric resin material plus any other appropriate material used in the manufacture of industrial process fabrics and paper machine clothing. However, each warp yarn may be a plied monofilament or the like. Each weft yarn is also preferably made of PPS, although in some embodiments PEEK or polyester may be used, and is a monofilament, plied monofilament, or the like.

Warp and weft yarns comprising PPS and/or PEEK advantageously provide a heat-resistant fabric layer 10. As such, the web-facing side 12 and other parts of the fabric layer 10 resists blemishes and damage caused by molten polymer drops occasionally formed during certain processes, such as spunbonding and meltblowing. Instead, the molten drops solidify on the web-facing side 12 and typically do not adhere to the fabric. However, an operator may use a scraper to remove any residual polymer drops that adhere to the fabric without damaging the fabric. As a result, the fabric does not form blemishes on the non-woven web after residual polymer drops are removed from the fabric. In addition, warp and weft yarns comprising PPS and/or PEEK advantageously provide a fabric layer 10 that resists corrosion caused by well-known cleaning chemicals, such as sulfuric acid for PET, solvents such as toluene or methyl ethyl ketone (MEK) for PE, or sulfuric acid followed by MEK for copolymers of PET and PE. As a result, instead of using a scraper, an operator may use these chemicals to dissolve any residual polymer drops without damaging the fabric.

In some embodiments, some of the weft yarns are antistatic yarns in order to provide a fabric layer which dissipates static electricity that accumulates during some dry forming processes. The antistatic yarns may be formed of carbon-impregnated nylon, metal, conductive PPS or conductive PEEK and conductive nylon using techniques described in U.S. Pat. No. 7,094,467, the disclosure of which is hereby incorporated by reference in its entirety. In these embodiments, the fabric may also include additional features, such as conductive edging, to form an electrostatic grid that dissipates static electricity.

It is contemplated that the fabric layer may use differing shapes and sizes for the yarns. For example, the warp yarns may have a greater thickness than the weft yarns, or vice versa. In some embodiments, the warp yarns may be round or circular with diameters in the range of 0.10 mm to 1.20 mm. However, in a preferred embodiment, the warp yarns have flat upper surfaces 16 (FIG. 3) that define a large portion of the web-facing side 12. The flat upper surfaces 16 may be formed by grinding the web-facing side 12 of the fabric, or, preferably, by using warp yarns with rectangular cross-sections. The rectangular warp yarns, if used, preferably have width and height dimensions in the range of 0.40 mm to 1.20 mm, and are most preferably 0.63 mm wide by 0.37 mm high. These preferred shapes and sizes advantageously reduce the mesh (number of warp yarns per inch) of the fabric by one half compared to previous designs.

The flat upper surfaces 16 of the warp yarns provide a sufficiently solid and flat support surface on the web-facing side 12 from which polymer drops can be removed easily with a scraper. That is, the molten polymer drops do not penetrate an upper plane of the fabric. The term "upper plane" should be understood to mean a plane beyond which polymer drops would create a mechanical form fit or wrap around yarns of the fabric. For example, the upper plane for a layer of round yarns would pass through the centers of the yarns. In contrast, the upper plane for a layer of rectangular yarns is at the bottom surface of the yarns. In any case, polymer drops cannot be removed easily with a scraper if the polymer drops flow past the upper plane, and an attempt to do so may damage the fabric. As a result, the surface tension of the polymer drops is preferably considered and the shapes and spacing between yarns are selected such that the polymer drops do not penetrate the upper plane of the fabric.

Figure 3:
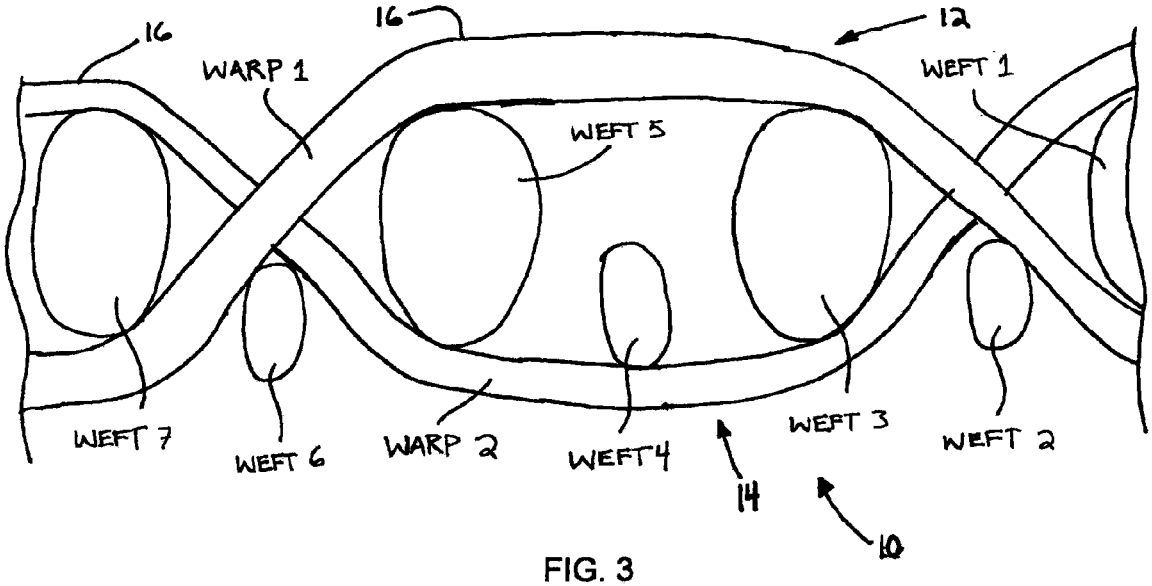
FIG. 3 is a side view of the weave pattern of several warps yarns with several weft yarns.
Figure 4:
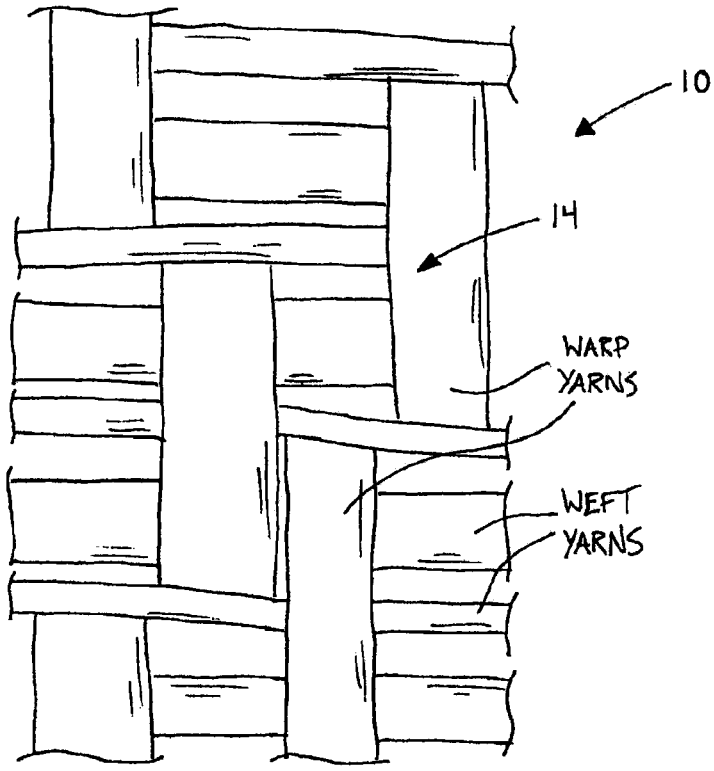
FIG. 4 is a view of a machine-facing side of the fabric of the invention.
Figure 6:
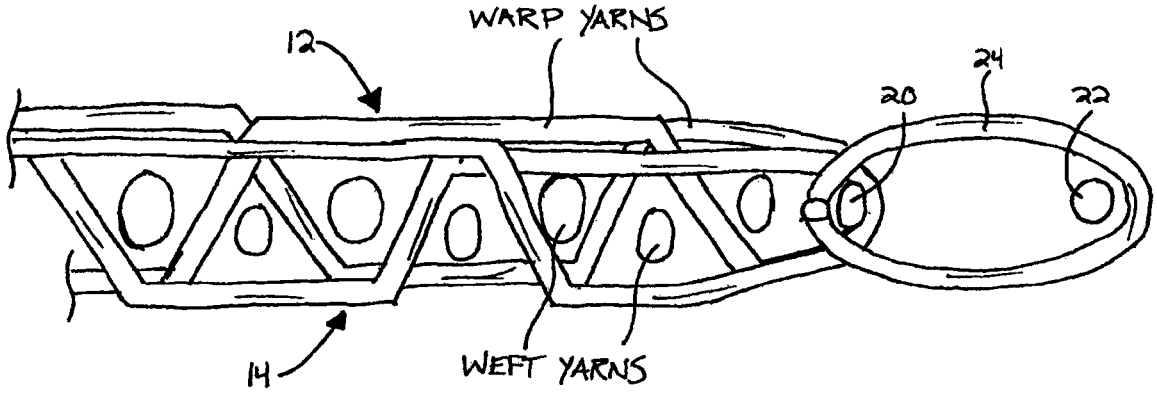
FIG. 6 is a side view of one end of the spiro-pin seam and the fabric of the invention.

The weft yarns may be, for example, circular, oval-shaped, circle-like or oval-like as shown in FIGS. 3 and 6. The weft yarns preferably have a diameter in the range of 0.10 mm to 1.20 mm and most preferably 0.70 mm. In embodiments in which some of the weft yarns are antistatic yarns, the antistatic yarns preferably have a diameter in the range of 0.10 mm to 1.10 mm and most preferably 0.28 mm.

In a preferred embodiment, the warp and weft yarns are woven as shown specifically in FIGS. 1-4. FIG. 1 shows a single repeating pattern area, or a "weave repeat", of the fabric layer that encompasses four warp yarns (yarns 1-4 extending vertically in FIG. 1) and eight weft yarns (yarns 1-8 extending horizontally in FIG. 1). In some embodiments, some of the weft yarns, for example, the even-numbered weft yarns, are antistatic weft yarns as described above. In FIG. 1, the symbol 'X' represents a position where a warp yarn passes over a weft yarn (e.g., warp yarn 1 passes over weft yarn 2) as viewed from the web-facing side of the fabric. Conversely, an empty box represents a position where a warp yarn passes under a weft yarn (e.g., warp yarn 1 passes under weft yarn 1) as viewed from the web-facing side of the fabric. FIG. 2 depicts the paths of warp yarns 1-4 as they weave with weft yarns 1-8. While FIGS. 1 and 2 only show a single section of the fabric, those of skill in the art will appreciate that in commercial applications the pattern shown in FIGS. 1 and 2 would be repeated many times, in both the warp and weft directions, to form a large fabric suitable for creating non-wovens.

Referring to FIGS. 1 and 2, each warp yarn weaves the same pattern with the weft yarns. That is, each warp yarn passes over five consecutive weft yarns, and then passes under three consecutive weft yarns. For example, warp yarn 1 passes over weft yarns 2-6, and then passes under weft yarns 7, 8, and 1. However, it should be noted that the pattern is offset between adjacent warp yarns; specifically, the pattern of one adjacent warp yarn is offset by four weft yarns, and the pattern the other adjacent warp yarn is offset by two weft yarns. For example, the last weft yarn passed over by warp yarn 2 is weft yarn 2, the last weft yarn passed over by warp yarn 1 is weft yarn 6 (i.e., an offset of four weft yarns), and the last weft yarn passed over by warp yarn 3 is weft yarn 4 (i.e., an offset of two weft yarns).

Each warp yarn defines a long warp float by passing over five consecutive weft yarns. These warp floats define a large portion of the web-facing side. Further still, the long warp floats advantageously contribute to the smoothness of the web-facing side. As described above, the smooth web-facing side permits polymer drops to be removed easily. It is also contemplated to use warp floats of other lengths because warp floats of any length (i.e., passing over two or more consecutive weft yarns) advantageously provide a web-facing side with some degree of smoothness. However, it is preferred to use warp floats that pass over less than six consecutive weft yarns to ensure that the fabric layer is relatively stable.

As described above, the long warp floats define a large portion of the web-facing side. However, weft floats that pass over two consecutive warp yarns (e.g., weft yarn 5 passes over warp yarns 2 and 3) also define a portion of the web-facing side. The weft floats are recessed compared to the long warp floats, and as a result, the weft floats define pockets on the web-facing side. The short length of the weft floats and pockets advantageously provide a sufficiently solid and flat support surface that prevents polymer drops from penetrating the upper plane of the web-facing side and creating a mechanical form fit with the fabric. Instead, polymer drops remain on the web-facing side and can be removed easily.

The fabric of the invention preferably has a permeability in the range of 50 cfm to 1200 cfm and most preferably about 500 cfm. The fabric preferably has a caliper in the range of 1 mm to 4 mm and most preferably about 1.5 mm. However, those skilled in the art will appreciate that the aforementioned characteristics depend on the yarn shape, yarn size and the weave pattern. As a result, appropriate permeability and caliper ranges may vary depending on the specific fabric design.

Figure 5:
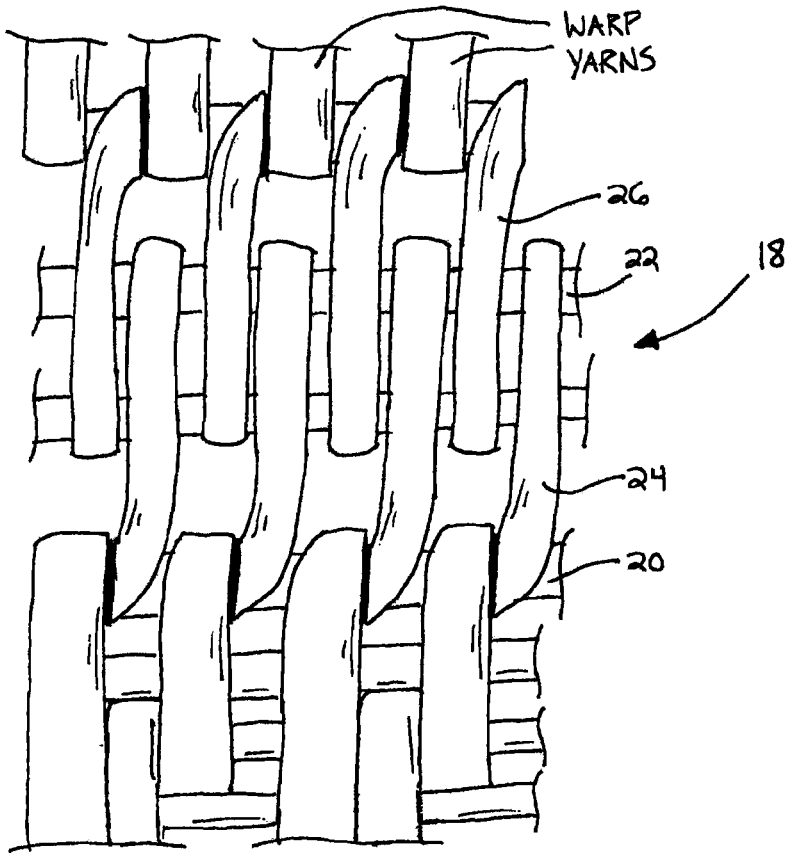
FIG. 5 is a top view of a spiral or "spiro-pin" seam connecting ends of the fabric of the invention.

The fabric of the invention may be formed as an endless belt without using additional components. However, in some embodiments, a well-known seam connects ends of the fabric layer to form a belt. Referring to FIGS. 5 and 6, the fabric preferably includes a spiral or "spiro-pin" seam 18 to connect the ends of the fabric. Referring to FIG. 6, one side of the spiro-pin seam 18 includes first and second anchor yarns 20 and 22 that support a spiral yarn 24 that extends in the weft direction. The first anchor yarn 20 also supports portions of the warp yarns proximate the seam 18, and the portions of the warp yarns are rewoven with adjacent weft yarns. Referring to FIG. 5, the spiral yarn 24 meshes with a second spiral yarn 26 on the opposite end of the fabric to form the endless belt.

Figure 7:
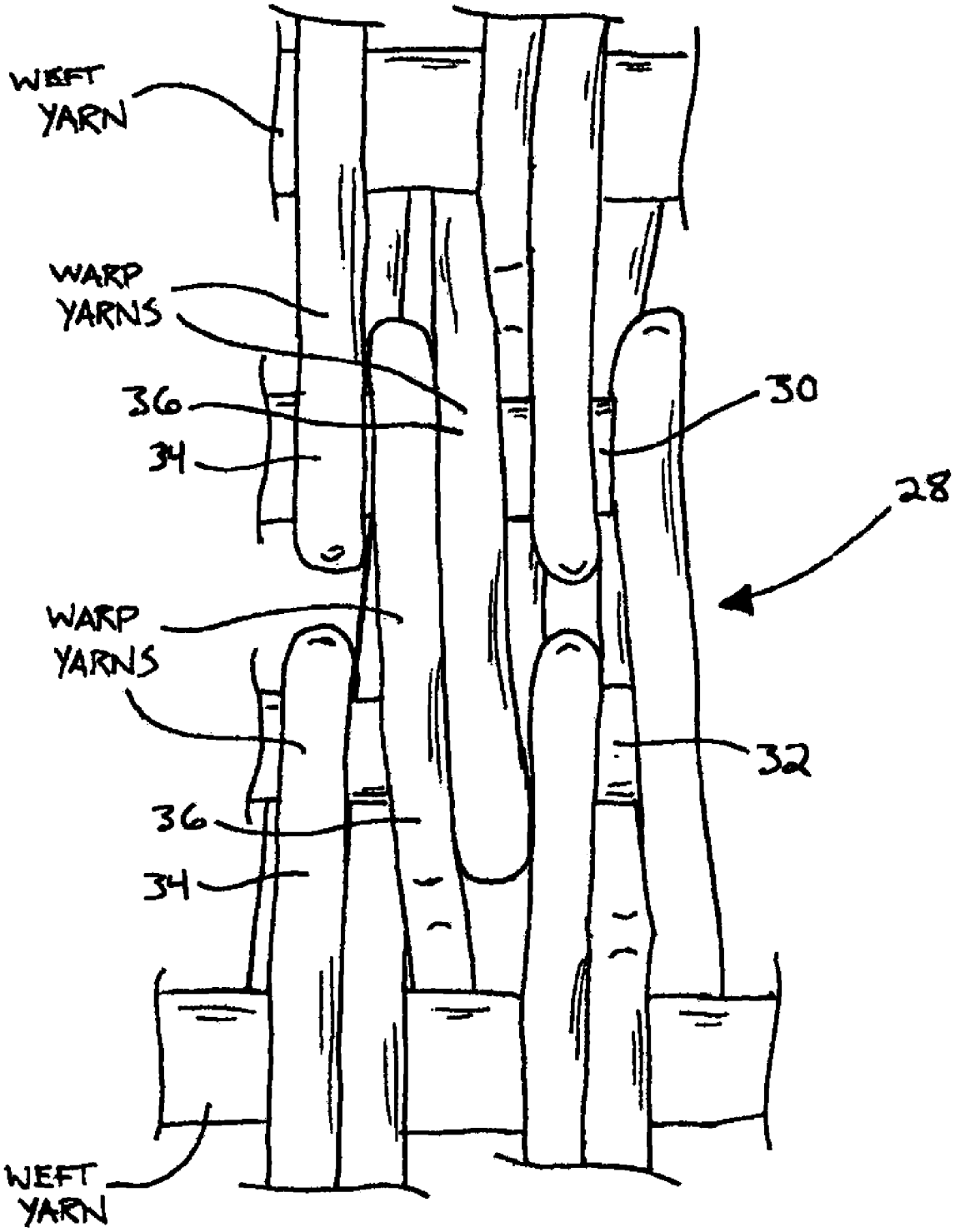
FIG. 7 is a top view of a double loop pin seam connecting ends of the fabric of the invention.

In some embodiments, the seam may be a single loop seam; such a seam is well-known to those skilled in the art. Further still, in some embodiments, the seam may be a double loop pin seam 28 as shown in FIG. 7. The double loop pin seam 28 includes first and second anchor yarns 30 and 32 that support first and second offset yarn loops 34 and 36 on each end of the fabric layer. The first and second yarns loops 34 and 36 are formed from portions of the warp yarns, and each weave repeat includes one set of first and second yarn loops 34 and 36. Other aspects of double loop pin seams are well-known to those skilled in the art. Regardless of the type of seam used, the seam preferably has the same permeability and caliper as other areas of the fabric to provide a non-marking fabric belt. In addition, the components of the seam (e.g. the anchor yarns and the spiral yarns) are preferably made from the same material as the warp and weft yarns (e.g., PPS or PEEK) to prevent damage from polymer drops and corrosion from cleaning chemicals.

The fabric layer of the invention is preferably manufactured as follows: first, the warp and weft yarns are woven using well-known techniques. The fabric is unstable and the yarns do not mesh well with one another after weaving because yarns formed from PPS and/or PEEK are relatively rigid compared to other types of yarns. The fabric is heat set and stretched to address this issue, and the yarns mesh with one another to provide a stable fabric. Next, if the fabric is to include a seam, yarns proximate the ends of the fabric are fringed and the warp yarns are rewoven with the seam components and the weft yarns. The fringed yarns are then clipped flushly with the web-facing or machine-facing side of the fabric to maintain the smoothness of the fabric. Finally, the seam is heat set so that the seam is in-line with other areas of the fabric and to ensure the seam is non-marking.

From the above disclosure it should be apparent that the fabric of the present invention can provide any combination of the following advantages: heat resistance and resistance to damage from molten polymer drops; corrosion resistance to chemicals that dissolve polymer drops; light weight and high strength; high permeability; and use of a heat and corrosion-resistant non-marking seam.

EXAMPLE

A fabric for a non-wovens application was woven on a loom utilizing Voith's weave pattern #24 plus a stuffer. The fabric included rectangular PPS warp (machine direction) yarns that were 0.63 mm wide by 0.37 mm high at 44 ends per inch. The weft (cross-machine direction) yarns had a diameter of 0.70 mm and alternated with 0.28 mm diameter carbon-impregnated nylon antistatic yarns at 30 picks per inch. The fabric was heat set at 480 degrees F. and stretched to 30 pli. The fabric was cut to length and then prepared for seaming. PEEK spiral yarns were installed at both ends and joined. The fabric was then cut to finished width and heat sealed. A carbon loaded adhesive was applied over a width of 1" along both edges. The carbon edge formed an electrostatic grid to dissipate static electricity accumulated during formation of non-wovens or paper products.

It is noted that the foregoing examples have been provided merely for the purpose of explanation and are in no way to be construed as limiting of the present invention. While the present invention has been described with reference to exemplary embodiments, it should be understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

We claim:

1. A fabric for supporting a fibrous web, comprising:

a layer having a web-facing side and a machine-facing side, the layer comprising:

a plurality of weft yarns comprising at least one of polyphenylene sulfide (PPS) and polyetheretherketone (PEEK);

a plurality of warp yarns interwoven with the plurality of weft yarns, the warp yarns comprising at least one of PPS and PEEK and at least some of the warp yarns having flat upper surfaces such that molten polymer drops do not penetrate an upper plane of the web-facing side; and wherein the weft yarns and the warp yarns create a plurality of weave repeats each comprising four warp yarns and eight weft yarns, each warp yarn in each weave repeat forming a pattern by passing over five consecutive weft yarns and then passing under three consecutive weft yarns, and the pattern formed by each warp yarn in each weave repeat is offset by four weft yarns from the pattern formed by a first adjacent warp yarn, and the pattern formed by each warp yarn in each weave repeat is offset by two weft yarns from the pattern formed by a second adjacent warp yarn.

2. The fabric of claim 1, further comprising a seam connected to the layer, the seam comprising at least one of PPS and PEEK.

3. The fabric of claim 2, wherein the seam is in-line relative to other areas of the fabric layer, and the seam has the same permeability as other areas of the fabric layer.

4. The fabric of claim 2, wherein the seam and other areas of the fabric have the same caliper.

5. The fabric of claim 2, wherein the seam includes a spiral yarn comprising at least one of PPS and PEEK.

6. The fabric of claim 5, wherein the seam includes at least one anchor yarn engaged with the spiral yarn and at least some of the warp yarns.

7. The fabric of claim 1, wherein the web-facing side includes a plurality of small pockets, each small pocket being defined by a weft yarn passing over at most two consecutive warp yarns.

8. The fabric of claim 7, wherein the warp and weft yarns define a weave repeat over at least a portion of the layer, the weave repeat including at most two small pockets.

9. The fabric of claim 1, wherein the warp yarns have rectangular cross-sections.

10. The fabric of claim 1, wherein at least some of the weft yarns are antistatic yarns comprising at least one of PPS and PEEK.

* * * * *